US007322551B2

(12) United States Patent
Simonsen

(10) Patent No.: US 7,322,551 B2
(45) Date of Patent: Jan. 29, 2008

(54) PORTABLE ARTICLE SUPPORT APPARATUS

(76) Inventor: Joseph M. Simonsen, P.O. Box 237, Malott, WA (US) 98829

( * ) Notice: Subject to any disclaimer, the term of this patent is extended or adjusted under 35 U.S.C. 154(b) by 188 days.

(21) Appl. No.: 11/043,466

(22) Filed: Jan. 25, 2005

(65) Prior Publication Data

US 2006/0175503 A1 Aug. 10, 2006

(51) Int. Cl.
*E04G 5/06* (2006.01)

(52) U.S. Cl. ..... 248/231.81; 248/228.7; 248/230.7; 248/303; 248/304; 248/309.2; 248/308; 248/315; 248/227.1; 248/227.4; 211/16; 211/88.04; 211/119.009; D6/546

(58) Field of Classification Search ..... 248/228.7, 248/230.7, 231.81, 304, 303, 309.2, 308, 248/315, 227.1, 227.4; 211/16, 88.04, 119.009; D6/546

See application file for complete search history.

(56) References Cited

U.S. PATENT DOCUMENTS 2,576,873 A 11/1951 Zelov
3,907,118 A * 9/1975 Pelavin ..... 211/113
4,637,582 A 1/1987 Boda
4,907,771 A 3/1990 Wang
5,186,427 A * 2/1993 Semchuck ..... 248/251
5,348,168 A 9/1994 Emery
5,413,297 A * 5/1995 Adams ..... 248/215
5,607,131 A * 3/1997 Adams ..... 248/215
5,799,804 A 9/1998 Sharpe
6,113,045 A * 9/2000 Kuo ..... 248/222.14
D441,582 S 5/2001 Moore
D450,508 S * 11/2001 Simonsen ..... D6/546
D474,679 S * 5/2003 Malin ..... D8/394
6,751,916 B1 6/2004 Ritzer et al.

* cited by examiner

*Primary Examiner*—Carl D. Friedman
*Assistant Examiner*—Nkeisha J. Dumas
(74) *Attorney, Agent, or Firm*—Daniel P. Dooley; Fellers, Snider, et al.

(57) ABSTRACT

An apparatus with a first and second loaf spring portions extending from a bridge portion, the second leaf spring portion provides an article support mounting aperture for attachment of an article support to the second leaf spring portion by structure for attaching said article support, and additional structure for securing the article support to the second leaf spring portion is disclosed. In a first embodiment, the article support is a towel ring, the structure for attaching the towel ring to the second leaf spring portion includes a shaft extending from a distal end of a post, and a retention groove formed at a distal end of the shaft. The additional structure for securing the shaft to the second leaf spring portion includes: a compression spring enclosing the shaft and interposed between the second leaf spring portion and the post; and a fastener affixed to the retention groove.

28 Claims, 9 Drawing Sheets

PORTABLE ARTICLE SUPPORT APPARATUS

FIELD OF THE INVENTION

This invention relates generally to apparatuses used to support household goods. More particularly, but not by way of limitation, to a portable article support apparatus, an example of which includes a portable article support apparatus for supporting a hand towel.

BACKGROUND

Article support apparatuses for household goods such as towels rings, towel bars, garment hooks, and toilet paper holders are typically fixed-in-place within a home, business, or recreational vehicle. To make household goods more accessible, people are known to drape towels over oven door handles, refrigerator handles, door handles on cabinetry doors below sinks, and drawer handles; or to place toilet paper on a shelf just inside a cabinet door, or on countertop adjacent the toilet, for example, because the fixed position toilet paper roll support apparatus is beyond a child's reach.

Generally speaking, it would be desirable for individuals to determine at will a preferred location for article support apparatuses for household goods, and the ability to alter at will their preferred location of those article support apparatuses in response to changing desires and needs for placement for household goods by the individual. For example, during times of illness it may be desirable to place a towel or a roll of toilet paper conveniently positioned and easily accessible adjacent the patient's bed, while leaving the top of the night stand for medicines, fluids, and facial tissue. As such, challenges remain and a need persists for improvements in devices and methods for conveniently and adaptively positioning and repositioning article support apparatuses for household goods in response to an individual's changing desires and needs.

SUMMARY OF THE INVENTION

The present invention preferably provides an apparatus with first and second leaf spring portions extending from a bridge portion, the second leaf spring portion preferably providing an article support mounting aperture for attachment of an article support by means for attaching said article support, and means for securing the article support to the second leaf spring portion. In a preferred embodiment, the article support is a towel ring, the means for attaching the towel ring to the second leaf spring portion includes a shaft extending from a distal end of a post, and a retention groove formed at a distal end of the shaft. The means for securing the shaft to the second leaf spring portion preferably includes a compression spring enclosing the shaft and interposed between a raised support region of the second leaf spring portion and a distal end of the post, and a fastener affixed to the retention groove.

The preferred embodiment further includes an article support confinement aperture provided at a proximal end of the post; and an article support motion bushing interposed between the article support confinement aperture and the towel ring. The article support motion bushing preferably provides a reduced friction surface for the towel ring to move relative to the post, the first and second leaf spring portions are preferably non-contactingly adjacent one another. The means for securing to the second leaf spring portion the means for attaching the towel ring to the second leaf spring portion preferentially includes, at least a raised support region adjacent the article support mounting aperture and a fastener affixed to the retention groove.

The preferred embodiment still further includes an escutcheon providing a compression spring retention aperture, the escutcheon is positioned adjacent the raised support region, interposed between the second leaf spring portion and the means for attaching the towel ring to the second leaf spring portion, and confines the compression spring within the compression spring retention aperture. The bridge, the first and second leaf spring portions each include at least an internal surface and an external surface, and in which the apparatus further comprises an interface surface material including at least an internal surface and an external surface. Preferably, the external surface of the interface surface material is secured to the internal surface of each: the bridge, the first and second leaf spring portions, and the internal surface of the interface surface material preferably mitigates abrasion of a surface interacting with the internal surface of the interface surface material, such as a door front of cabinetry.

These and various other features and advantages, which characterize the present invention, will be apparent from a reading of the following detailed description and a review of the associated drawings.

DETAILED DESCRIPTION

Before explaining the present invention in detail, it is important to understand that the invention is not limited in its application to the details of the construction illustrated and the steps described herein. The invention is capable of other embodiments and of being practiced or carried out in a variety of ways. It is to be understood that the phraseology and terminology employed herein is for the purpose of description and not of limitation.

Figure 1:
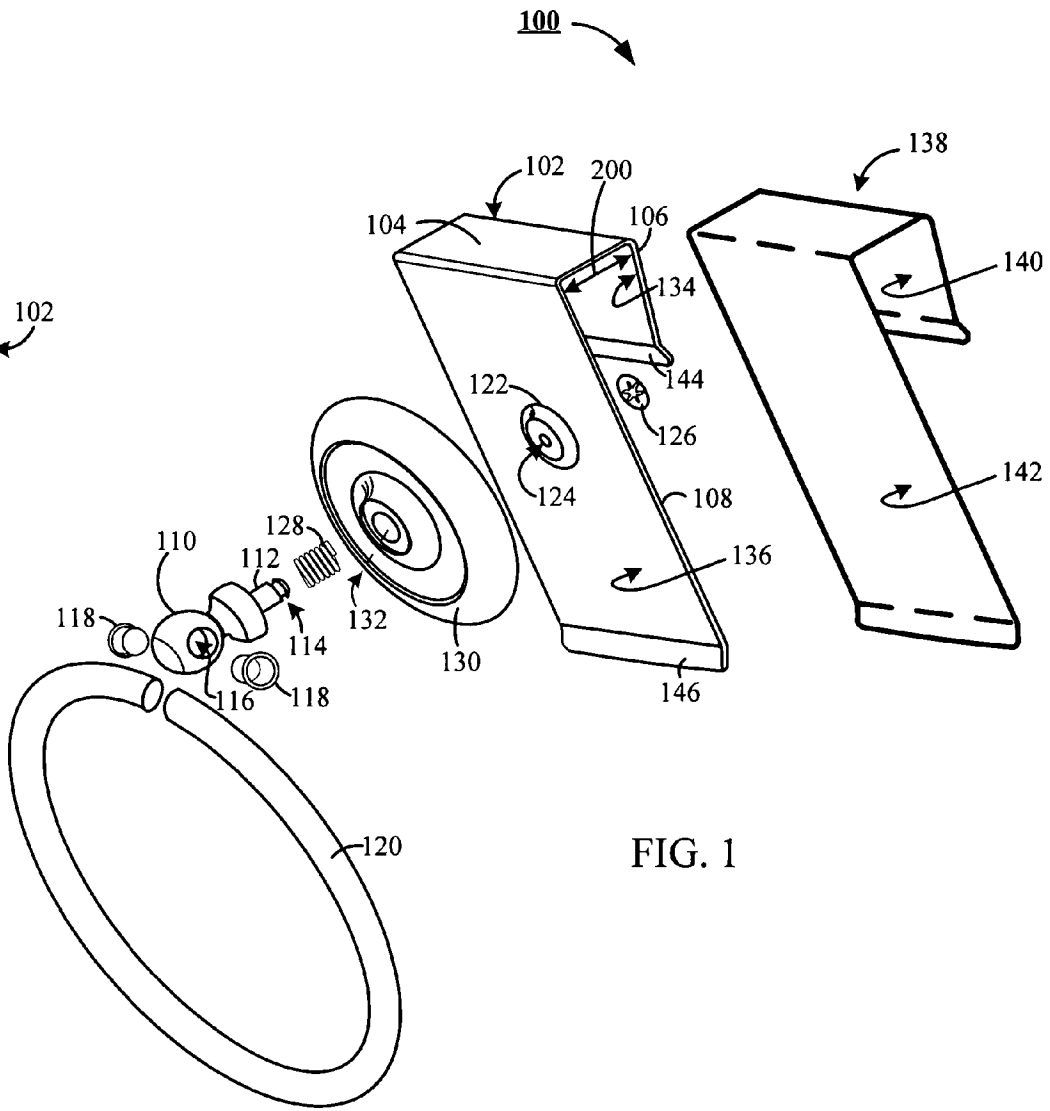
FIG. 1 provides an exploded perspective view of a preferred embodiment of the present inventive portable article support apparatuses.

Referring now to the drawings, wherein like reference numerals indicate the same parts throughout the several views, a preferred embodiment of an inventive portable article support apparatus (apparatus) 100 of FIG. 1 includes a utility clip 102, which provides: a bridge portion 104; a first leaf spring portion 106 extending from a first end of the bridge portion 104; and a second leaf spring portion 108 extending from a second end of the bridge portion 104. The apparatus 100 further includes an article support (to be discussed in greater detail below) attached to the second leaf spring portion 108 by means for attaching the article support to the second leaf spring portion 108, and means for securing to the second leaf spring portion said attaching means.

In a preferred embodiment, the means for attaching the article support to the second leaf spring portion 108 includes a post 110, a shaft 112 with a proximal end rigidly affixed to a distal end of the post 110, a retention groove 114 formed at a distal end of the shaft 112, an article support confinement aperture 116 provided at a proximal end of the post 110, and an article support motion bushing 118. The article support motion bushing 118 is interposed between the article support confinement aperture 116 and the article support, to provide a reduced friction surface for the article support to move relative to the post 110.

In a preferred embodiment, the first and second leaf spring portions (106 and 108) are each: non-contactingly adjacent one another; joined to the bridge portion 104 at a proximal end; and encounter a decreasing distance between one another while progressing from their respective proximal ends to their respective distal ends. The article support of a preferred embodiment is a towel ring 120, and the means for securing to the second spring leaf portion 108 the means for attaching the towel ring 120 to the second leaf portion 108 includes at least: a raised support region 122 of the second leaf spring portion 108, which encloses an article support mounting aperture 124; a fastener 126 adjacent the raised support region 122; a compression spring 128 interposed between the raised support region 122 and a distal end of the post 110; and an escutcheon 130 providing a compression spring retention aperture 132 interposed between the second leaf spring portion 108 and the distal end of the post 110, and confining the compression spring 128.

The article support mounting aperture 124 is configured for sliding communication with the shaft 112, and upon pushing the shaft 112 through the article support mounting aperture 124, and exposing the retention groove 114 on the backside of the article support mounting aperture 124, the fastener 126 is pressed into locking engagement with the retention groove 114. The fastener 126 constrains both transverse and lateral movement of the shaft 112 with any article support mounting aperture 124, while accommodating rotational motion of the post 110 relative to the second leaf spring portion 108. In pushing the shaft 112 through the article support mounting aperture 124, the compression spring 128 undergoes compression, which results in a spring load being applied to each the post 110 and the raised support region 122. The spring load acts to modulate the rotational motion of the post 110 relative to the second leaf spring portion 108.

In an alternate embodiment, the fastener 126 is replaced with a fastener 127 (see FIG. 11), wherein fastener 127 is configured to impart a spring load against each the back side of the raised support region 122 and the shaft 112, once the fastener 127 lockingly engages the retention groove 114. The spring load delivered by the fastener 127 is developed as a result of increasing a length of tang members 129 (see FIG. 11) of the fastener 127 compared to a length of tang members 125 (see FIG. 11) of the fastener 126.

In a preferred embodiment, the bridge portion 104, the first leaf spring portion 106, and the second leaf spring portion 108 collectively form an internal surface 134 and an external surface 136. The apparatus 100 preferably further includes an interface material 138 that includes at least an internal surface 140, and an external surface 142. Preferably, the external surface 142 is secured to the collective internal surface 134 of the utility clip 102, and the internal surface 140 provides a nonabrasive surface, which mitigates abrasion of a surface interacting with the internal surface 140. The interface material 138 preferably extends to cover a first flared engagement portion 144, of the first leaf spring portion 106, and a second flared engagement portion 146, of the second leaf spring portion 108. The interface material 140 is preferably constructed from felt, but other materials such as leather; microfiber fabrics; or other long wearing, low abrasive equivalent material may be used. It is also noted that the utility clip 102 is preferably constructed from stainless-steel, but may be constructed from other materials such as carbon fiber composites, or rigid polymers, that is polymers with yield points greater than stainless-steel and which are non susceptible to breakage.

Figure 2:
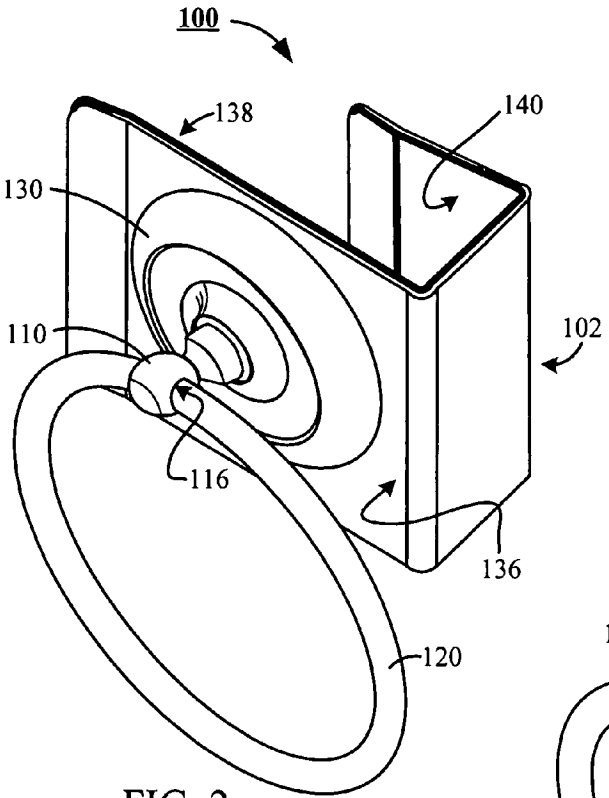
FIG. 2 provides a perspective view of the preferred embodiment of the inventive portable article support apparatuses of FIG. 1.

FIG. 2 is provided to show the towel ring embodiment of the inventive portable article support apparatus 100 and its assembled form. It is noted that by providing the ability to orient the towel ring 120 relative to the external surface 136 of the utility clip 102, the towel ring embodiment of the inventive portable article support apparatus 100 is fully functional whether the first and second leaf spring portions (106 and 108 of FIG. 1) engage, for example, a top edge of a cabinet door, or a side edge of the cabinet door.

Figure 3:
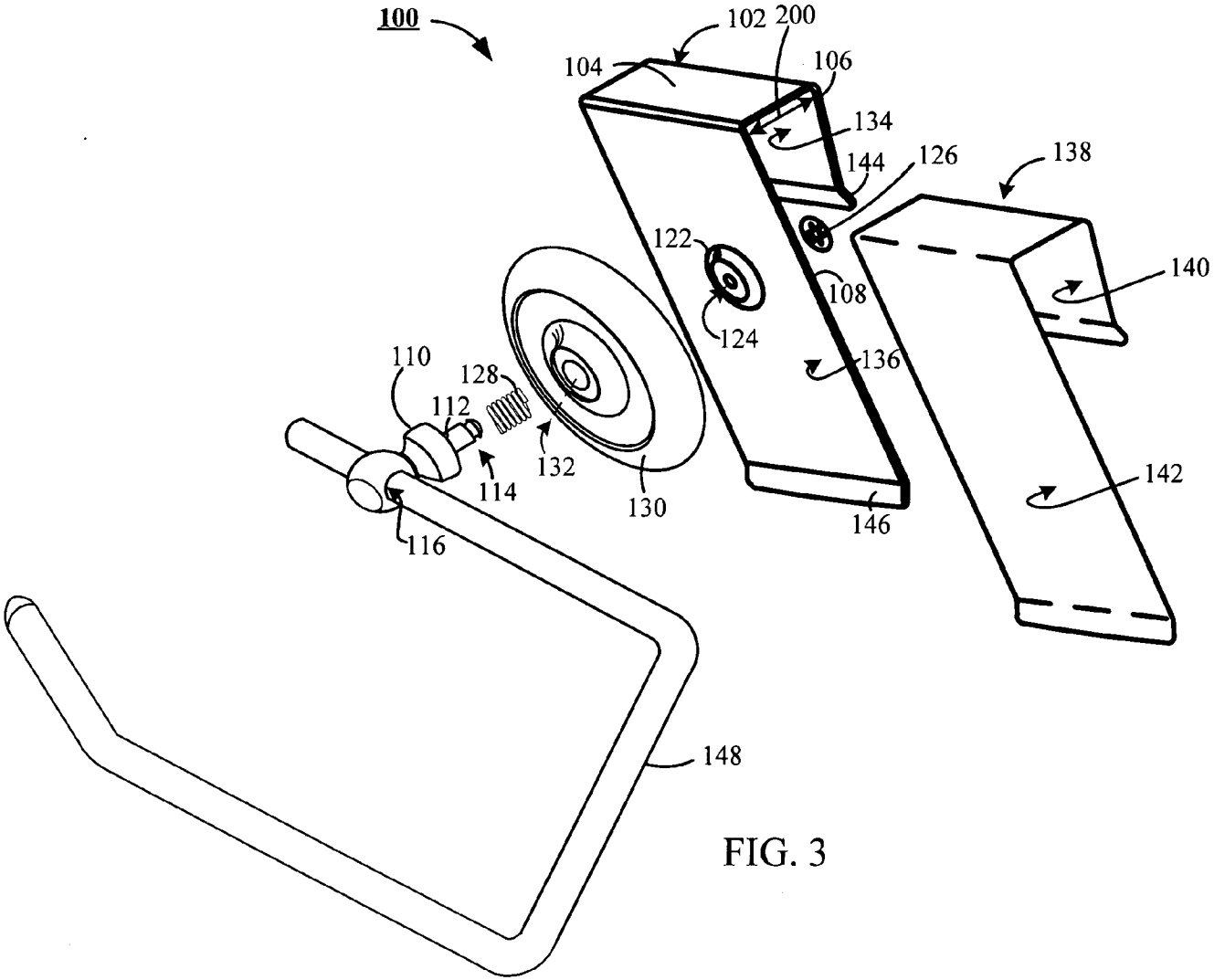
FIG. 3 provides an exploded perspective view of an alternate preferred embodiment of the present inventive portable article support apparatuses.

Continuing with FIG. 3, shown therein is a toilet paper roll dispenser embodiment of the inventive portable article support apparatus 100. In the toilet paper roll dispenser embodiment, a toilet paper roll support 148 replaces the towel ring 120 of FIG. 2. Other than the article supported, i.e., either a towel or a roll of toilet paper, both the toilet paper roll dispenser embodiment, and the towel ring embodiment of the inventive portable article support apparatus 100 provide the same convenience, ease-of-use, and portability.

Figure 4:
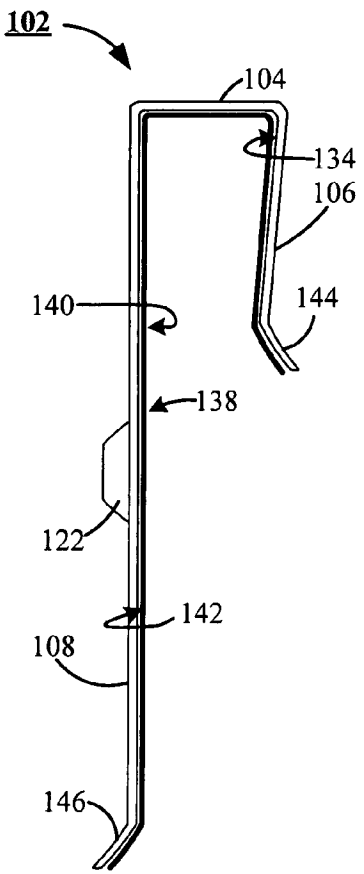
FIG. 4 provides a side elevational view of a bridge portion with first and second spring leaf portions extending therefrom of the alternate preferred embodiment of the present inventive portable article support apparatuses of FIG. 3.

FIG. 4 is provided to enhance an understanding of the relationship between various features of the utility clip 102 and the interface material 138, in particular, the relationship between the raised support region 122 of the utility clip 102, and the external surface 142 of the interface material 138. By securing the external surface 142 of the interface material 138 to the collective internal surface 134 of the utility clip 102, a pocket is created to conceal the fastener 126 interacting with the retention groove 114 (of FIG. 3). It is also noted that by concealing the interaction of the fastener 126 with the retention groove 114, a continuous substantially smooth internal surface 140 of the interface material 138 is presented for interaction with mating surfaces, such as an external surface of a door or drawer front of cabinetry.

Figure 5:
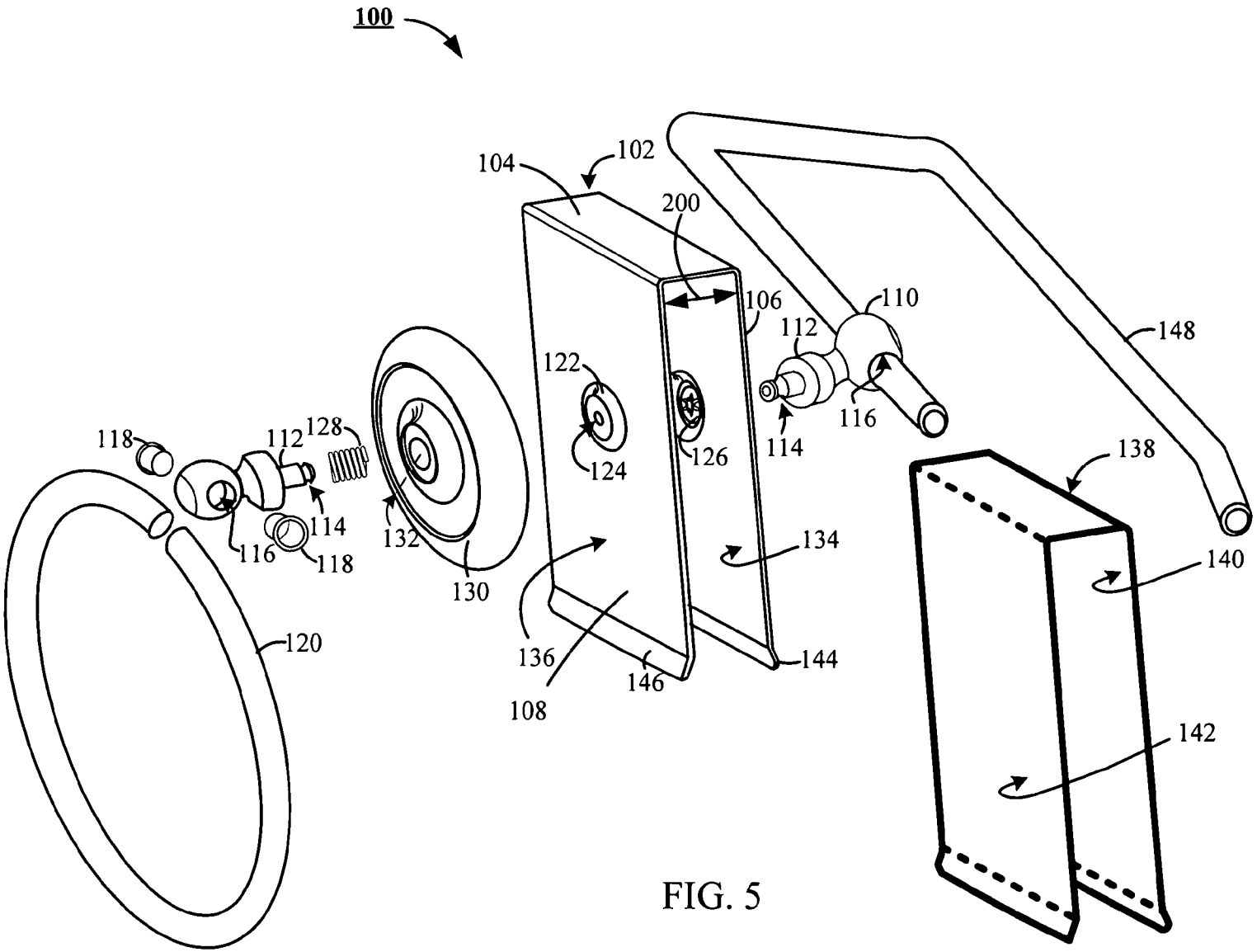
FIG. 5 provides an exploded perspective view of another alternate preferred embodiment of the present inventive portable article support apparatuses.
Figure 6:
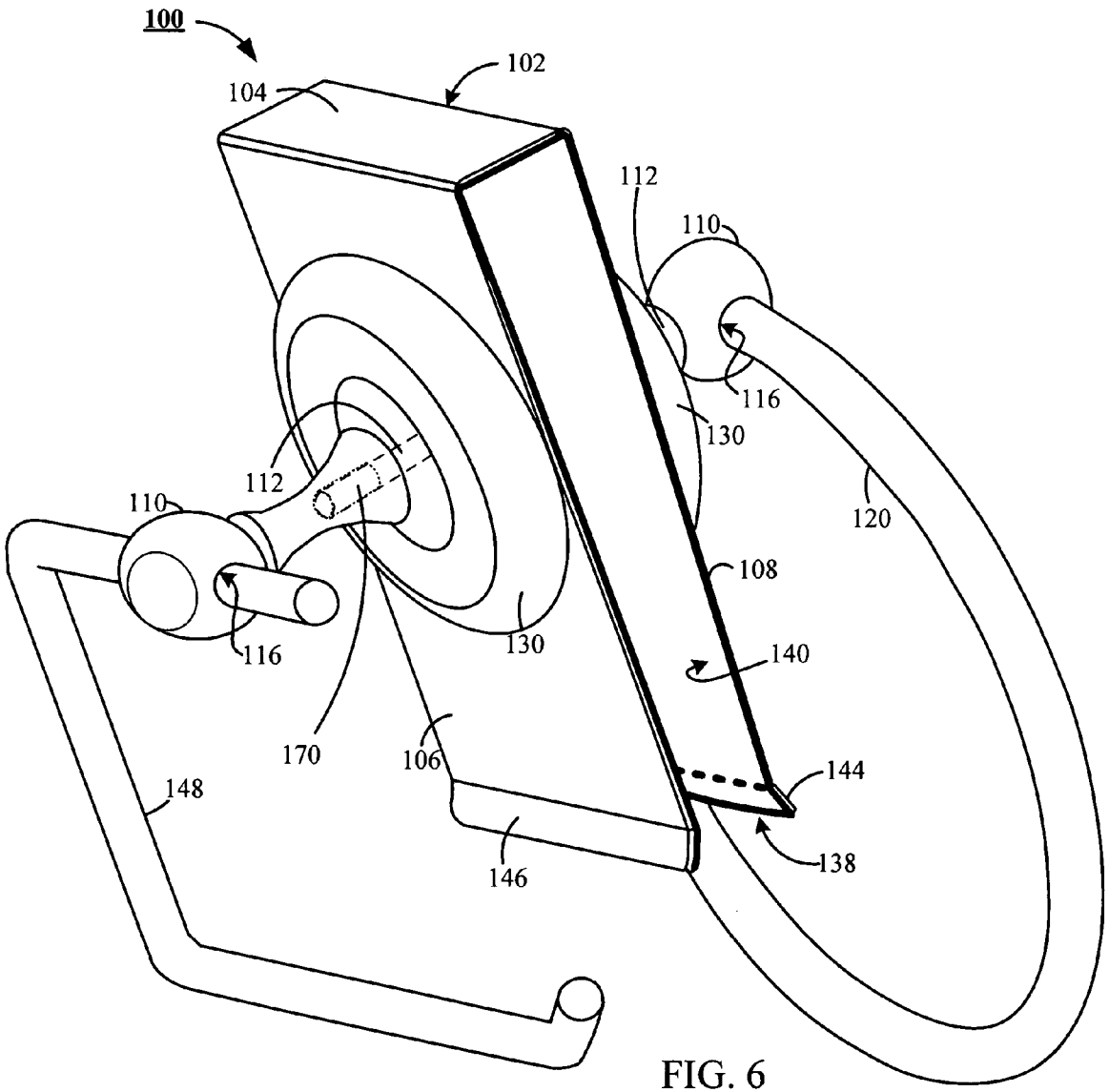
FIG. 6 provides a perspective view of the another alternate preferred embodiment of the inventive portable article support apparatuses of FIG. 5.

Referring next to FIGS. 5 and 6, shown therein is a combination toilet paper roll dispenser and towel ring embodiment of the inventive portable article support apparatus 100. In providing a combination toilet paper roll and towel ring embodiment, it is noted that the first leaf spring portion 106 is extended to be of substantially the same length as the second leaf spring portion 108, and that the interface material 138 is configured for attachment to the collective internal surface 134 of the utility clip 102. Other than the configuration alterations of the utility clip 102 and the interface material 138, the remaining components are common to those of the towel ring embodiment of FIG. 2, and the toilet paper roll embodiment of FIG. 3. FIG. 6 further shows a retention aperture 170 (shown in small dashed line outline form) formed within the body of the post 110, and accessible from the distal end of the post 110. During the assembly operation the shaft 112 (shown in large dashed line outline form) is pressed into locking engagement with the post 110 via the retention aperture 170.

Figures 7, 8:
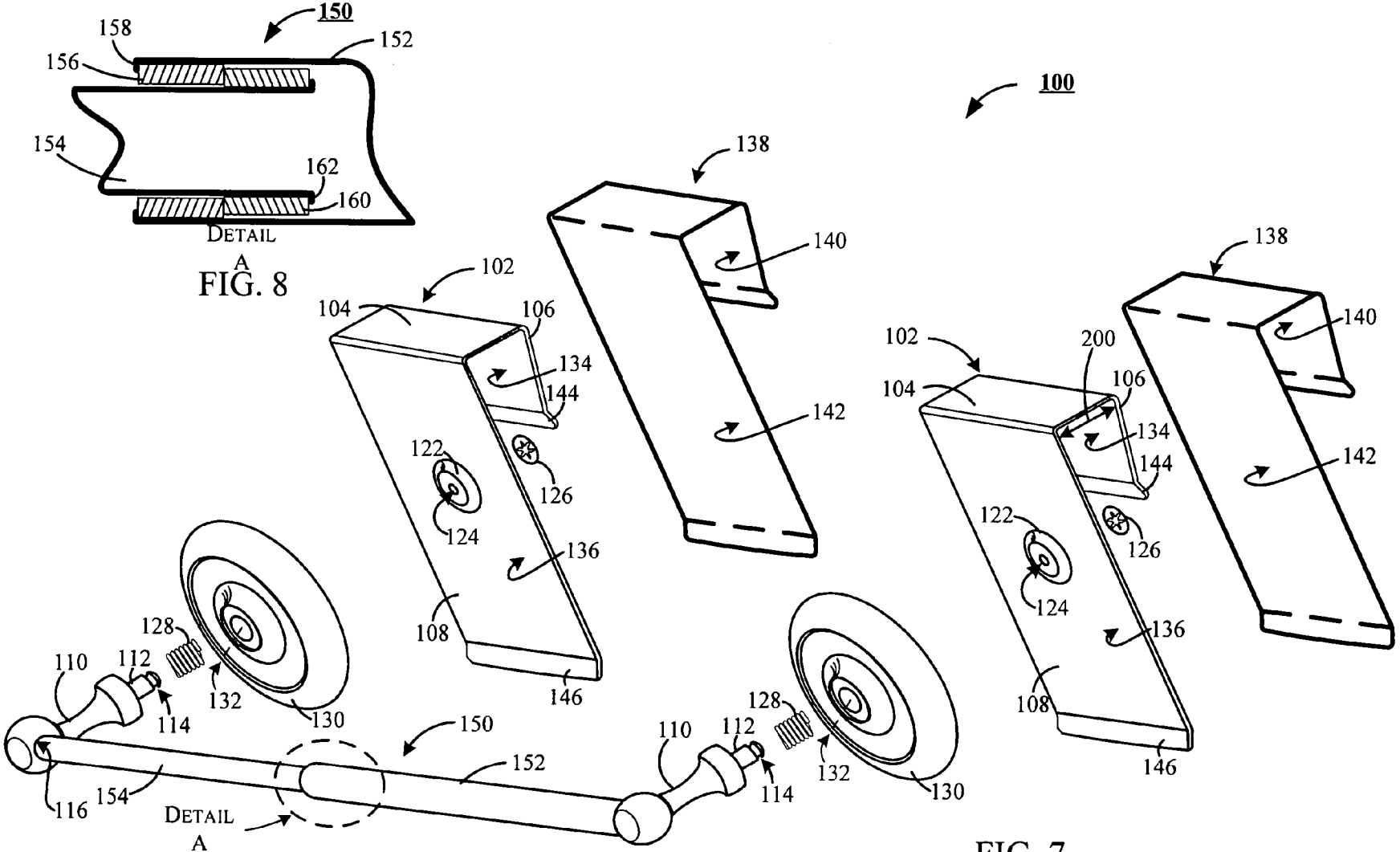
FIG. 7 provides an exploded perspective view of a further alternate preferred embodiment of the present inventive portable article support apparatuses.
FIG. 8 provides a partial cutaway elevational view of a pair of confinement bushings of an expandable towel bar of the further alternate preferred embodiment of the inventive portable article support apparatuses of FIG. 7.

FIGS. 7 and 8 collectively show an expandable towel bar embodiment of the inventive portable article support apparatus 100. The expandable towel bar embodiment includes an expandable bar portion 150 with at least one hollow bar portion 152 configured to accommodate a corresponding sliding bar portion 154 in a slip fit relationship. That is, the hollow bar portion 152 is configured to allow a slip fit relationship between an internal diameter of the hollow bar portion 152 and an external diameter of the corresponding sliding bar portion 154. As shown by FIG. 8, a first confinement bushing 156 is confined within the internal diameter of the hollow bar portion 152 by a flange portion 158 of the hollow bar portion 152, and a second confinement bushing 160 is confined adjacent the external diameter of the corresponding sliding bar portion 154 by a flange portion 162 of the corresponding sliding bar portion 154. When the first confinement bushing 156 interacts with the second confinement bushing 160, the corresponding sliding bar portion 154 is precluded from becoming disengaged from the hollow bar portion 152.

Figure 10:
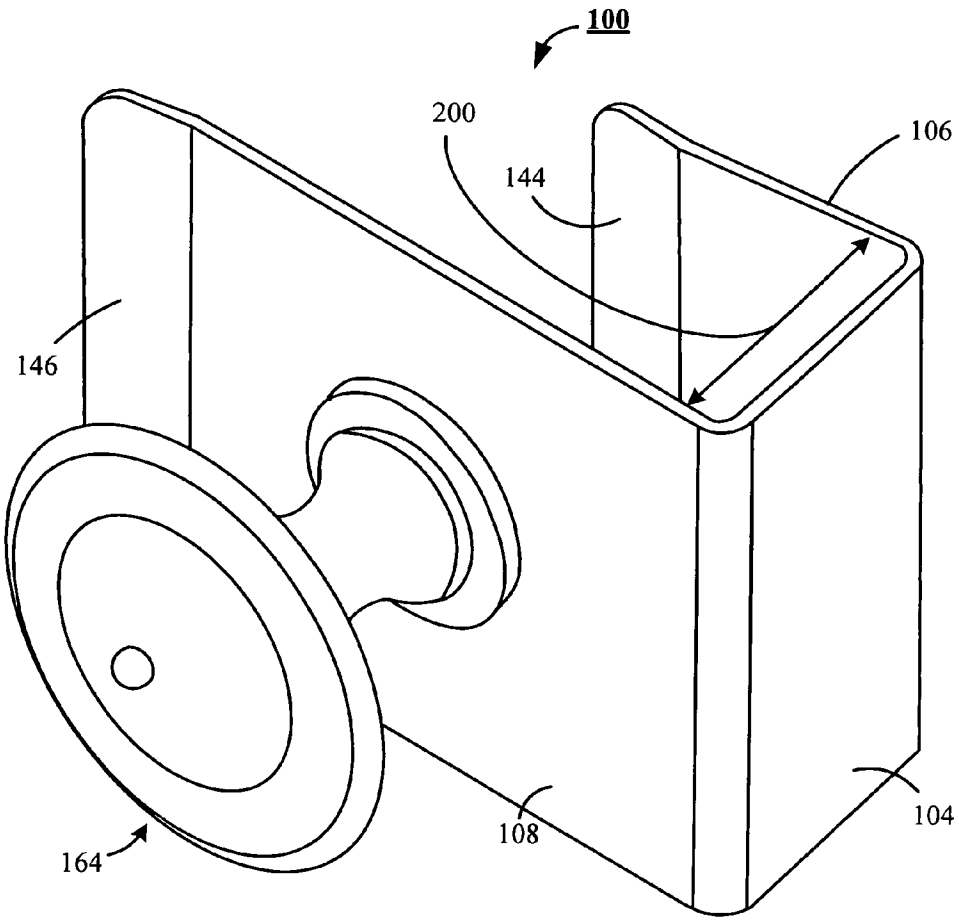
FIG. 10 provides a perspective view of the alternative preferred embodiment of the inventive portable article support apparatuses of FIG. 9.
Figure 9:
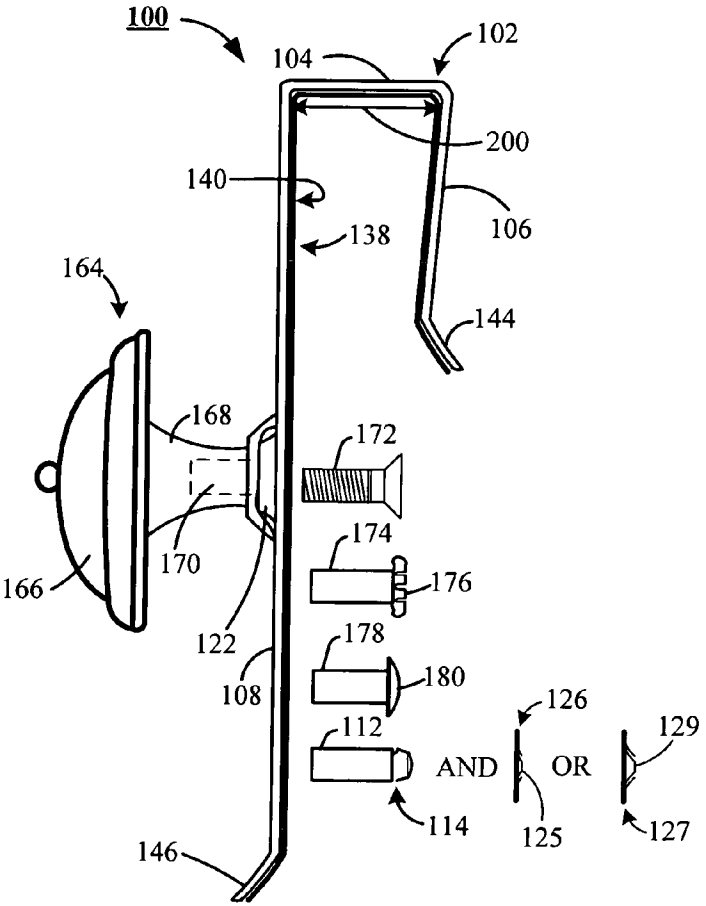
FIG. 9 provides a partial cutaway side elevational view of an alternative preferred embodiment of the present inventive portable article support apparatuses.

FIGS. 9 and 10 collectively show a finger pull embodiment of the inventive portable article support apparatus 100. The finger pull embodiment includes a finger pull portion 164 that includes at least a knob portion 166 with a shaft portion 168 affixed to the knob portion 166. Preferably, the finger pull embodiment further includes the retention aperture 170 formed within a body portion of the shaft portion 168 and accessible from a distal end of the shaft portion 168. In a preferred embodiment, the retention aperture 170 is a threaded retention aperture configured to interact with a threaded fastener 172 to provide the means for securing the finger pull portion 164 to the utility clip 102.

In another preferred finger pull embodiment, the retention aperture 170 is configured to accommodate a pressing of a proximal end of a retention dowel 174 into locking engagement with the retention aperture 170. With the retention dowel 174 pressed into position within the retention aperture 170, a staking operation forms a staked head 176 on the distal end of the retention dowel 174 to provide the means for securing the finger pull portion 164 to the utility clip 102.

In an alternate preferred finger pull embodiment, the retention aperture 170 is configured to accommodate passage of a barrel portion of a rivet 178, in which the barrel portion (not separately shown) of the rivet 178 is in a slip fit relationship with the retention aperture 170. With the barrel portion of the rivet 178 positioned within the retention aperture 170, a head portion 180 of the rivet 178 is preferably positioned in pressing contact adjacent a backside surface of the raised support region 122. Upon activation of the rivet 178, the barrel portion expands into locking engagement with the retention aperture 170, and the head portion 180 draws into pressing engagement with the backside surface of the raised support region 122 to provide the means for securing the finger pull portion 164 to the utility clip 102.

In another alternate finger pull preferred embodiment, the retention aperture 170 is configured to accommodate pressing of the distal end of the shaft 112 into locking engagement with the retention aperture 170. With the distal end of the shaft 112 positioned within the retention aperture 170, and with the retention groove 114 on the distal end of the shaft 112 protruding beyond the backside surface of the raised support region 122, the fastener 126 is pressed into locking engagement with the retention groove 114 to provide the means for securing the finger pull portion 164 to the utility clip 102. However, to accommodate a control rotation of the utility clip 102 relative to an article support (such as the towel ring 120, the toilet paper roll support 148, or the expandable bar portion 150), the fastener 127 may be used as an alternate to the fastener 126 to provide the means for securing the finger pull portion 164 to the utility clip 102.

Figure 12:
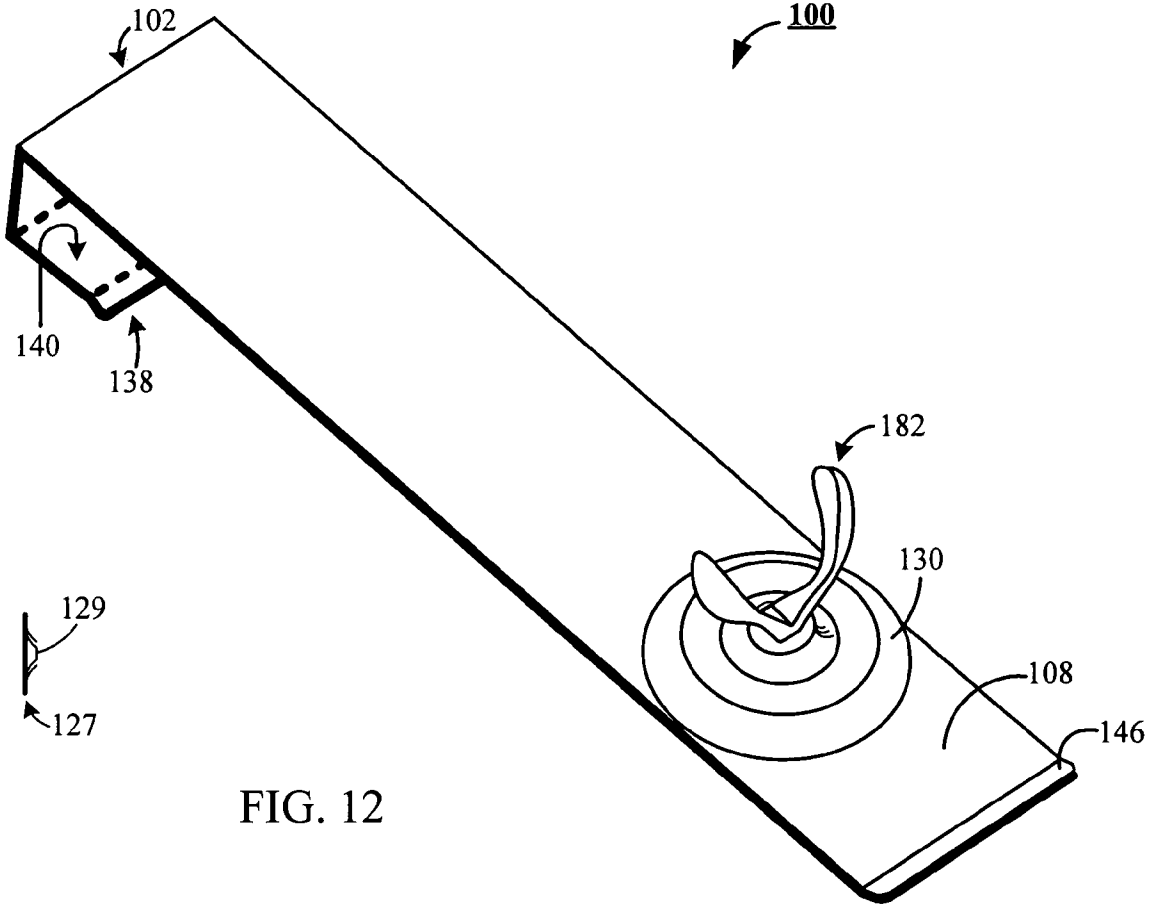
FIG. 12 provides a perspective view of the alternate alternative preferred embodiment of the inventive portable article support apparatuses of FIG. 11.
Figure 11:
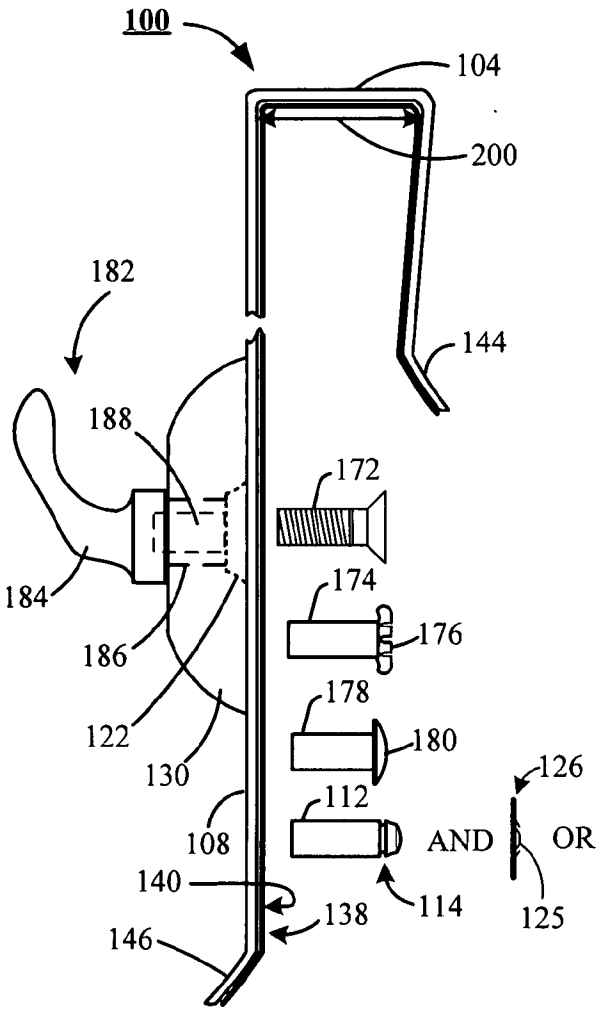
FIG. 11 provides a partial cutaway side elevational view of an alternate alternative preferred embodiment of the present portable inventive article support apparatuses.

FIGS. 11 and 12 collectively show a garment hook embodiment of the inventive portable article support apparatus 100. The garment hook embodiment includes a garment hook portion 182 that includes at least a hook portion 184 with a shaft portion 186 affixed to the hook portion 184. Preferably, the garment hook embodiment further includes a retention aperture 188 formed within a body portion of the shaft portion 186 and is accessible from a distal end of the shaft portion 186. In a preferred embodiment, the retention aperture 188 is a threaded retention aperture configured to interact with the threaded fastener 172 to provide the means for securing the garment hook portion 182 to the utility clip 102.

In another preferred garment hook embodiment, the retention aperture 188 is configured to accommodate a pressing of the proximal end of the retention dowel 174 into locking engagement with the retention aperture 188. With the retention dowel 174 pressed into position within the retention aperture 188, a staking operation forms the staked head 176 on the distal end of the retention dowel 174 to provide the means for securing the garment hook portion 182 to the utility clip 102.

In an alternate preferred garment hook embodiment, the retention aperture 188 is configured to accommodate passage of the barrel portion of the rivet 178, in which the barrel portion of the rivet 178 is in a slip fit relationship with the retention aperture 188. With the barrel portion of the rivet 178 positioned within the retention aperture 188, the head portion 180 of the rivet 178 is preferably positioned in pressing contact adjacent the backside surface of the raised support region 122. Upon activation of the rivet 178, the barrel portion expands into locking engagement with the retention aperture 188, and the head portion draws into pressing engagement with the backside surface of the raised support region 122 to provide the means for securing the finger pull portion 164 to the utility clip 102.

In another alternate garment hook preferred embodiment, the retention aperture 188 is configured to accommodate pressing of the distal end of the shaft 112 into locking engagement with the retention aperture 188. With the distal end of the shaft 112 positioned within the retention aperture 188, and with the retention groove 114 on the distal end of the shaft 112 protruding beyond the backside surface of the raised support region 122, the fastener 126 is pressed into locking engagement with the retention groove 114 to provide the means for securing the finger pull portion 164 to the utility clip 102. However, to accommodate a control rotation of the utility clip 102 relative to an article support (such as the towel ring 120, the toilet paper roll support 148, or the expandable bar portion 150), the fastener 127 may be used as an alternate to the fastener 126 to provide the means for securing the finger pull portion 164 to the utility clip 102.

Figure 13:
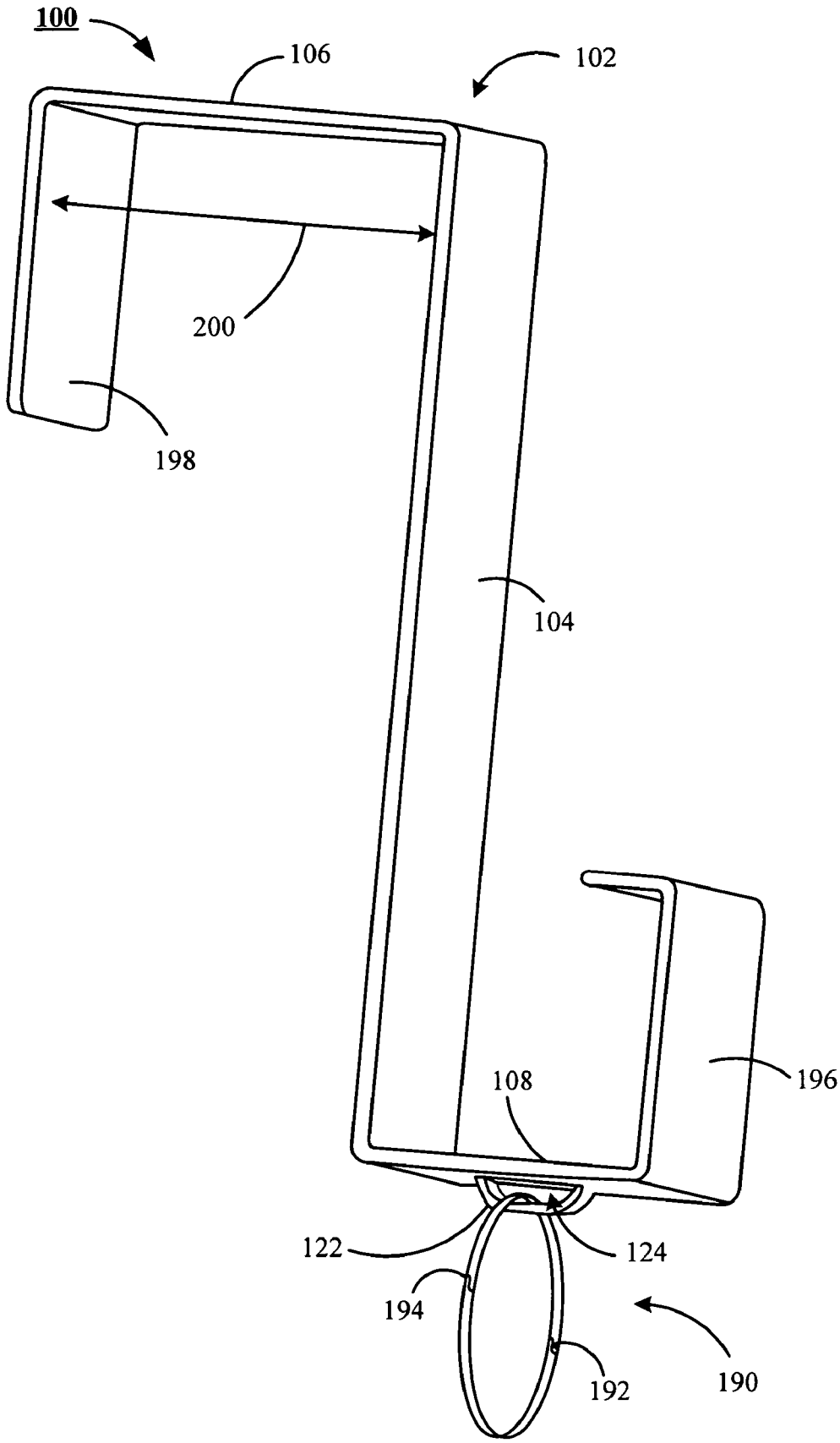
FIG. 13 provides a perspective view of an alternative alternate preferred embodiment of the present inventive portable article support apparatuses.

FIG. 13 shows a key ring embodiment of the inventive portable article support apparatus 100. The key ring embodiment includes a key ring 190 that includes at least: a hinge portion 192, which provides access to an internal surface of the key ring; and a locking clasp 194 that mitigates an unwanted removal of the key ring 190 from the utility clip 102. Preferably, the key ring embodiment further includes a configuration that features: the first leaf spring portion 106 extending in a first direction from the bridge portion 104; the second leaf spring portion 108 extending in a second direction from the bridge portion 104, and wherein the first and second leaf spring portions (106, 108) are non adjacent one another. In securing the key ring 190 to the utility clip 102, the locking clasp 194 is opened, and the hinge portion 192 promotes the provision of an opening between a first and a second clasp portion (not shown separately) of the locking clasp 194. The first clasp portion is passed through the article support mounting aperture 124, and the second clasp portion of the locking clasp 194 is re-clasped to the first clasp portion to secure the key ring 190 to the raised support region 122.

Preferably, the first and second leaf spring portions (106, 108) each join the bridge portion 104 at their respective proximal ends, and the key ring embodiment further includes an article retention member 196 extending from a distal end of the second leaf spring portion 108, and a retention hook member 198 extending from a distal end of the first leaf spring portion 106. Preferentially, the article retention member 196, and the retention hook member 198 each extend in a direction that is substantially parallel to the bridge portion 104. It is noted that in the key ring embodiment a distance 200, between the proximal and distal end of the first leaf spring portion is substantially twenty-two millimeters, which is substantially the same distance between the proximal ends of the first and second leaf spring portions of at least the: towel ring; toilet paper roll dispenser; combination toilet paper roll dispenser and towel ring; expandable towel bar, and finger pull embodiments of the inventive portable article support apparatus 100.

Figure 14:
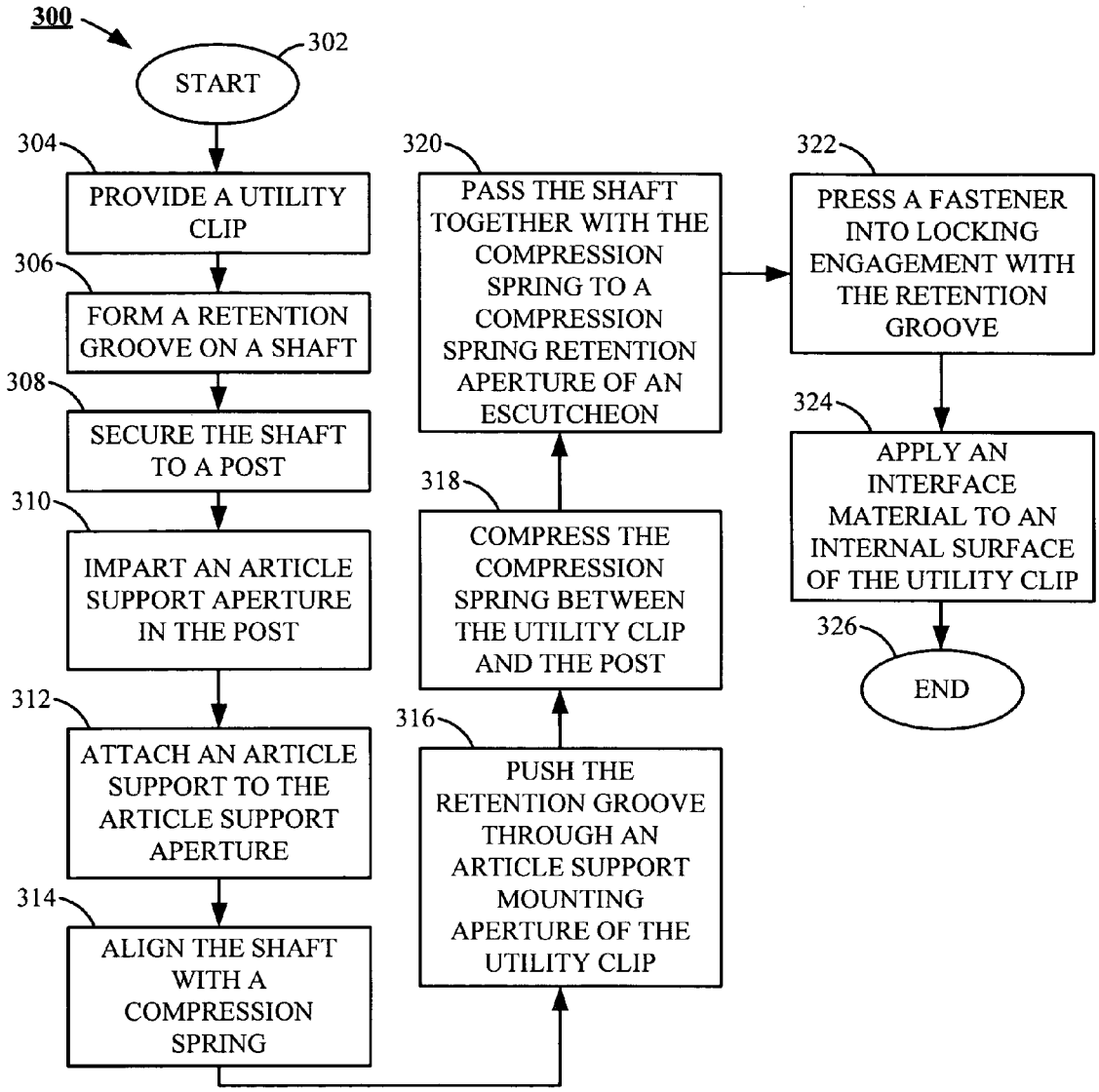
FIG. 14 illustrates a flow chart of a method of making the inventive portable article support apparatuses of FIG. 1.

FIG. 14 shows a method 300 of making an inventive portable article support apparatus, such as 100. The method commences at start process step 302, and continues with process step 304. At process step 304, a utility clip, such as 102, is provided. The utility clip preferably includes at least a bridge portion, such as 104, joined at a proximal end of each a first leaf spring portion, such as 106, and a second leaf spring portion 108. In a preferred embodiment, a raised support region, such as 122, and an article support mounting aperture 124 that is substantially centrally located within the raised support region is provided by the second leaf spring portion. The article support mounting aperture is preferably configured for sliding interaction with a shaft, such as 112. At process step 306, a retention groove, such as 114, is formed on a distal end of the shaft, and at process step 308, a proximal end of the shaft is secured within a retention aperture, such as 170, or 188, of a post, such as 110. Access to the retention aperture is preferably provided on a distal end of the post.

The method continues at process step 310, where an article support confinement aperture, such as 116, is fashioned within a body portion of the post, and is accessed through a proximal end of the post. At process step 312, an article support (such as the towel ring 120, the toilet paper roll support 148, or the expandable bar portion 150) is attached to the post via the article support confinement aperture. At process step 314, a compression spring, such as 128, is aligned with the shaft. At process step 316, the shaft, together with the compression spring are passed through a compression spring retention aperture, such as 132, of an escutcheon, such as 130; and the retention groove is pushed through the article support mounting aperture. At process step 318, the compression spring is compressed between a raised support region of the utility clip and the distal end of the post, and at process step 320, the retention groove of the shaft is pushed through the article support mounting aperture.

Continuing at process step 322, a fastener, such as 126, is pressed over the distal end of the shaft and into locking engagement with the retention groove. At process step 324, an external surface, such as 142, of an interface material, such as 138, is attached to a collective internal surface, such as 134, of the utility clip and the method concludes at end process step 326.

Thus, the present invention is well adapted to carry out the advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. An article support apparatus comprising:

a bridge portion;

a first leaf spring portion extending from a first end of the bridge portion;

a second leaf spring portion extending from a second end of the bridge portion, wherein the second leaf spring portion provides an article support mounting aperture;

an article support attached to the second leaf spring portion by means for attaching the article support to the second leaf spring portion; and means for securing to the second leaf spring portion said attaching means.

2. The apparatus of claim 1, in which the first and second leaf spring portions are non-contactingly adjacent one another, and further in which the means for attaching the article support to the second leaf spring portion comprises:

a post;

a shaft with a proximal end rigidly affixed to a distal end of the post, wherein the shaft is configured for sliding communication with the article support mounting aperture; and a retention groove formed at a distal end of the shaft.

3. The apparatus of claim 2, in which the article support comprises a towel ring, and in which the means for attaching the towel ring to the second leaf spring portion further comprises:

an article support confinement aperture provided at a proximal end of the post; and an article support motion bushing interposed between the article support confinement aperture and the towel ring, the article support motion bushing providing a reduced friction surface for the towel ring to move relative to the post.

4. The apparatus of claim 1, in which the comprising spring load is provided by a compression spring, and further comprising an escutcheon providing a compression spring retention aperture, the escutcheon adjacent the raised support region, interposed between the second leaf spring port and the means for attaching the towel ring to the second leaf spring portion, and confining the compression spring within the compression spring retention aperture.

5. The apparatus of claim 3, in which the bridge portion, and the first and second leaf spring portions collectively comprise an internal surface and an external surface, and in which the apparatus further comprises an interface surface material comprising an internal surface and an external surface, wherein the external surface of the interface surface material is secured to the collective internal surface of the bridge portion, and the first and second leaf spring portions, and further wherein the internal surface of the interface surface material mitigates abrasion of a surface interacting with the internal surface of the interface surface material.

6. The apparatus of claim 5, in which said surface interacting with the internal surface of the interface surface material comprises a surface of a cabinet door.

7. The apparatus of claim 2, in which the article support comprises a toilet paper roll support, and in which the means for attaching the toilet paper roll support to the second leaf spring portion further comprises:

an article support confinement aperture provided at a proximal end of the post; and an article support motion bushing interposed between the article support confinement aperture and the toilet paper roll support, the article support motion bushing providing a reduced friction surface for the toilet paper roll support to move relative to the post.

8. The apparatus of claim 7, in which the compression spring load is provided by a compression spring, and further comprising an escutcheon providing a compression spring retention aperture, the escutcheon adjacent the raised support region, interposed between the second leaf spring portion and the distal end of the post, and confining the compression spring within the compression spring retention aperture.

9. The apparatus of claim 8, in which the bridge portion, and the first and second leaf spring portions collectively comprise an internal surface and an external surface, and in which the apparatus further comprises an interface surface material comprising an internal surface and an external surface, wherein the external surface of the interface surface material is secured to the collective internal surface of the bridge portion, and the first and second leaf spring portions, and further wherein the internal surface of the interface surface material mitigates abrasion of a surface interacting with the internal surface of the interface surface material.

10. The apparatus of claim 9, in which the surface interacting with the internal surface of the interface surface material comprises a surface of a cabinet door.

11. The apparatus of claim 1, in which the first and second leaf spring portions are non-contactingly adjacent one another, the first spring portion provides a second article support mounting aperture, and further comprising:

a second article support communicating with the first leaf spring portion;

means for attaching the second article support to the first leaf spring portion;

means for securing to the first leaf spring portion the means for attaching the second article support to the first leaf spring portion, wherein the means for attaching the article support to the second leaf spring portion, and the means for attaching the second article support to the first leaf spring portion each comprises:

a post;

a shaft with a proximal end rigidly affixed to a distal end of the post, wherein the shaft is in sliding communication with the article support mounting aperture; and a retention groove formed at a distal end of the shaft.

12. The apparatus of claim 11, in which the article support comprises a towel ring, the second article support comprises a toilet paper roll support, and in which the means for attaching the towel ring to the second leaf spring portion and the means for attaching the toilet paper roll support to the first leaf spring portion each further comprising:

an article support confinement aperture provided at a proximal end of each post;

an article support motion bushing interposed between the article support confinement aperture of a first post of the posts and the towel ring, the article support motion bushing providing a reduced friction surface for the towel ring to move relative to the first post; and an article support motion bushing interposed between the article support confinement aperture of a second post of the posts and the toilet paper roll support, the article support motion bushing providing a reduced friction surface for the toilet paper roll support to move relative to the second post.

13. The apparatus of claim 12, in which the first and second leaf spring portions are non-contactingly adjacent one another, and further in which the means for securing to the second leaf spring portion the means for attaching the towel ring to the second leaf spring portion, and the means for securing to the first leaf spring portion the means for attaching the toilet paper roll support to the second leaf spring portion comprises:

a raised support region adjacent the article support mounting aperture;

a fastener adjacent the raised support region and affixed to the retention groove rigidly affixed to the first post, the fastener constraining transverse and lateral movement of the first post relative to the second leaf spring portion, while accommodating rotational motion of the first post to the second leaf spring portion;

a compression spring load interposed between the raised support region and the distal end of the first post, the compression spring load modulating the rotational motion of the first post relative to the second leaf spring portion;

a second raised support region adjacent the second article support mounting aperture;

a second fastener adjacent the second raised support region and affixed to the retention groove rigidly affixed to the second post, the fastener constraining transverse and lateral movement of the second post relative to the first leaf spring portion, while accommodating rotational motion of the second post to the first leaf spring portion; and a second compression spring load interposed between the second raised support region and the distal end of the second post, the second compression spring load modulating the rotational motion of the second post relative to the first leaf spring portion.

14. The apparatus of claim 13, in which the first compression spring load is provided by a first compression spring, the second compression spring load is provided by a second compression spring, and further comprising:

a first escutcheon providing a compression spring retention aperture, the first escutcheon adjacent the raised support region, interposed between the second leaf spring portion and the distal end of the first post, and confining the first compression spring within the compression spring retention aperture; and a second escutcheon providing a second compression spring retention aperture, the second escutcheon adjacent the second raised support region, interposed between the first leaf spring portion and the distal end of the second post, and confining the second compression spring within the second compression spring retention aperture.

15. The apparatus of claim 14, in which the bridge portion, the first and second leaf spring portions collectively comprise an internal surface and an external surface, and in which the apparatus further comprises an interface surface material comprising an internal surface and an external surface, wherein the external surface of the interface surface material is secured to the collective internal surface of the bridge portion, and the first and second leaf spring portions, and further wherein the internal surface of the interface surface material mitigates abrasion of a surface in sliding communication with the internal surface of the interface surface material.

16. The apparatus of claim 15, in which the surface interacting with the internal surface of the interface surface material comprises a surface of a cabinet door.

17. The apparatus of claim 2, in which the article support comprises an adjustable towel bar, and in which the means for attaching the adjustable towel bar to the second leaf spring portion further comprises:

an article support confinement aperture provided at a proximal end of the post; and an article support motion bushing interposed between the article support confinement aperture and the adjustable towel bar, the article support motion bushing providing a reduced friction surface for the adjustable towel bar to move relative to the post.

18. The apparatus of claim 17, in which the compression spring load is provided by a compression spring, and further comprising an escutcheon providing a compression spring retention aperture, the escutcheon adjacent the raised support region, interposed between the second leaf spring portion and the distal end of the post, and confining the compression spring within the compression spring retention aperture.

19. The apparatus of claim 18, in which the bridge, the first leaf spring, and the second leaf spring portions collectively comprise an internal surface and an external surface, and in which the apparatus further comprises an interface surface material comprising an internal surface and an external surface; wherein the external surface of the interface surface material is secured to the collective internal surface of each the bridge, and the first and second leaf spring portions, and further wherein the internal surface of the interface surface material mitigates abrasion of a surface interacting with the internal surface of the interface surface material.

20. The apparatus of claim 19, in which the surface comprises a surface of a cabinet door.

21. The apparatus of claim 20, in which the adjustable towel bar comprises:

a first rod portion with an interior and exterior diameter;

a first confinement bushing confined adjacent the interior diameter of the first rod portion by means for inhibiting escapement of the first bushing from a distal end of the first rod portion;

a second rod portion with an interior and exterior diameter; and a second confinement bushing confined adjacent the exterior diameter of the second rod portion by means for inhibiting escapement of the second bushing from a distal end of the second rod portion.

22. The apparatus of claim 21, in which the means for inhibiting escapement of the first bushing from the distal end of the first rod portion comprises a flange, the means for inhibiting escapement of the second bushing from the distal end of the second rod portion comprises a second flange, and in which the first bushing provides an interior diameter configured for sliding communication with the exterior diameter of the second rod portion such that when the second bushing is positioned into pressing contact adjacency with the first bushing, the second rod portion is precluded from separating from the first rod portion.

23. The apparatus of claim 4, in which the first leaf spring portion comprises a proximal end joined to the bridge portion, the second leaf spring portion comprises a proximal end joined to the bridge portion, and in which a distance between the proximal ends of the first and second leaf spring portions is substantially twenty-two millimeters.

24. The apparatus of claim 6, in which the first leaf spring portion comprises a proximal end joined to the bridge portion, the second leaf spring portion comprises a proximal end joined to the bridge portion, and in which a distance between the proximal ends of the first and second leaf spring portions is substantially twenty-two millimeters.

25. The apparatus of claim 10, in which the first leaf spring portion comprises a proximal end joined to the bridge portion, the second leaf spring portion comprises a proximal end joined to the bridge portion, and in which a distance between the proximal ends of the first and second leaf spring portions is substantially twenty-two millimeters.

26. The apparatus of claim 16, in which the first leaf spring portion comprises a proximal end joined to the bridge portion, the second leaf spring portion comprises a proximal end joined to the bridge portion, and in which a distance between the proximal ends of the first and second leaf spring portions is substantially twenty-two millimeters.

27. The apparatus of claim 22, in which the first leaf spring portion comprises a proximal end joined to the bridge portion, the second leaf spring portion comprises a proximal end joined to the bridge portion, and in which a distance between the proximal ends of the first and second leaf spring portions is substantially twenty-two millimeters.

28. The apparatus of claim 1, in which the fastener is configured to impart the compressive spring load against each the raised support region and the shaft upon engagement of the retention groove by the fastener.

* * * * *

UNITED STATES PATENT AND TRADEMARK OFFICE

CERTIFICATE OF CORRECTION

PATENT NO. : 7,322,551 B2
APPLICATION NO. : 11/043466
DATED : January 29, 2008
INVENTOR(S) : Joseph M. Simonsen It is certified that error appears in the above-identified patent and that said Letters Patent is hereby corrected as shown below:

In the claims section:

Col. 8, lines 38 – 49, please replace claim 1 with the following:

1. An article support apparatus comprising:
a bridge portion;
a first leaf spring portion extending from a first end of the bridge portion;
a second leaf spring portion extending from a second end of the bridge portion, wherein the second leaf spring portion provides an article support mounting aperture;
an article support attached to the second leaf spring portion by means for attaching the article support to the second leaf spring portion; and
means for securing to the second leaf spring portion said attaching means, <u>in which the article support is a towel ring, the first and second leaf spring portions are non-contactingly adjacent one another, and further in which the means for securing to the second leaf spring portion said attaching means comprises:</u>
<u>a raised support region enclosing the article support mounting aperture;</u>
<u>a fastener adjacent the raised support region and affixed to the means for attaching the towel ring to the second leaf spring portion, the fastener constraining transverse and lateral movement of the means for attaching the towel ring to the second leaf spring portion relative to the second leaf spring portion, while accommodating rotational motion of the means for attaching the towel ring to the second leaf spring portion relative to the second leaf spring portion; and</u>
<u>a compression spring load interposed between the raised support region and the means for attaching the towel ring to the second leaf spring portion, the compression spring load modulating the rotational motion of the means for attaching the towel ring to the second leaf spring portion relative to the second leaf spring portion.</u>

Col. 8, lines 50 – 59, please replace claim 2 with the following:

2. The apparatus of claim 1, ~~in which the first and second leaf spring portions are non-contactingly adjacent one another, and further~~ in which the means for attaching the ~~article support~~ <u>towel ring</u> to the second leaf spring portion comprises:
a post;
a shaft with a proximal end rigidly affixed to a distal end of the post, wherein the shaft is configured for sliding communication with the article It is certified that error appears in the above-identified patent and that said Letters Patent is hereby corrected as shown below:

support mounting aperture; and
a retention groove formed at a distal end of the shaft.

Col. 8, lines 60 – Col. 9, lines 1 – 3, please replace claim 3 with the following:

3. The apparatus of claim 2, ~~in which the article support comprises a towel ring, and~~ in which the means for attaching the towel ring to the second leaf spring portion further comprises:
an article support confinement aperture provided at a proximal end of the post; and
an article support motion bushing interposed between the article support confinement aperture and the towel ring, the article support motion bushing providing a reduced friction surface for the towel ring to move relative to the post.

Col. 9, lines 4 – 11, please replace claim 4 with the following:

4. The apparatus of claim 4 1, in which the ~~comprising~~ compression spring load is provided by a compression spring, and further comprising an escutcheon providing a compression spring retention aperture, the escutcheon adjacent the raised support region, interposed between the second leaf spring portion and the means for attaching the towel ring to the second leaf spring portion, and confining the compression spring within the compression spring retention aperture.

Col. 9, lines 26 – 36, please replace claim 7 with the following:

7. An article support apparatus comprising:
a bridge portion;
a first leaf spring portion extending from a first end of the bridge portion;
a second leaf spring portion extending from a second end of the bridge portion, wherein the second leaf spring portion provides an article support mounting aperture;
an article support attached to the second leaf spring portion by means for attaching the article support to the second leaf spring portion; and
means for securing to the second leaf spring portion said attaching means, in which the means for attaching the article support to the second leaf spring portion comprises:
a post;
a shaft with a proximal end rigidly affixed to a distal end of the post, wherein the shaft is configured for sliding communication with the article support mounting aperture;

It is certified that error appears in the above-identified patent and that said Letters Patent is hereby corrected as shown below:

a retention groove formed at a distal end of the shaft;
a raised support region adjacent the article support mounting aperture;
a fastener adjacent the raised support region and affixed to the retention groove, the fastener constraining transverse and lateral movement of the post relative to the second leaf spring portion, while accommodating rotational motion of the post to the second leaf spring portion; and
a compression spring load interposed between the raised support region and the distal end of the post, the compression spring load modulating the rotational motion of the post relative to the second leaf spring portion
~~The apparatus of claim 2~~, and in which the article support comprises a toilet paper roll support, and further in which the means for attaching the toilet paper roll support to the second leaf spring portion further comprises:
an article support confinement aperture provided at a proximal end of the post; and
an article support motion bushing interposed between the article support confinement aperture and the toilet paper roll support, the article support motion bushing providing a reduced friction surface for the toilet paper roll support to move relative to the post.

Col. 9, lines 60 through Col. 10, line 12, please replace claim 11 with the following:

11. An article support apparatus comprising:
a bridge portion;
a first leaf spring portion extending from a first end of the bridge portion;
a second leaf spring portion extending from a second end of the bridge portion, wherein the second leaf spring portion provides an article support mounting aperture;
an article support attached to the second leaf spring portion by means for attaching the article support to the second leaf spring portion; and
means for securing to the second leaf spring portion said attaching means, in which the means for securing to the second leaf spring portion said attaching means comprises:
a raised support region enclosing the article support mounting aperture;
a fastener adjacent the raised support region and affixed to the means for attaching the article support to the second leaf spring portion, the fastener constraining transverse and lateral movement of the means for attaching the article support to the second leaf spring portion relative to the second leaf spring portion, while accommodating rotational motion of the means It is certified that error appears in the above-identified patent and that said Letters Patent is hereby corrected as shown below:

for attaching the article support to the second leaf spring portion relative to the second leaf spring portion; and a compression spring load interposed between the raised support region and the means for attaching the article support to the second leaf spring portion, the compression spring load modulating the rotational motion of the means for attaching the article support to the second leaf spring portion relative to the second leaf spring portion, ~~The apparatus of claim 1~~ and in which the first and second leaf spring portions are non-contactingly adjacent one another, the first spring portion provides a second article support mounting aperture, and further comprising:

a second article support communicating with the first leaf spring portion;

means for attaching the second article support to the first leaf spring portion; and means for securing to the first leaf spring portion the means for attaching the second article support to the first leaf spring portion. ~~, wherein the means for attaching the article support to the second leaf spring portion, and the means for attaching the second article support to the first leaf spring portion each comprises:~~

~~a post;~~

~~a shaft with a proximal end rigidly affixed to a distal end of the post, wherein the shaft is in sliding communication with the article support mounting aperture; and~~

~~a retention groove formed at a distal end of the shaft.~~

Col. 10, lines 13 – 30, please replace claim 12 with the following:

12. The apparatus of claim 11, in which the article support comprises a towel ring, the second article support comprises a toilet paper roll support, and in which the means for attaching the towel ring to the second leaf spring portion and the means for attaching the toilet paper roll support to the first leaf spring portion each ~~further~~ comprising:

a post;

a shaft with a proximal end rigidly affixed to a distal end of the post, wherein the shaft is in sliding communication with the article support mounting aperture;

It is certified that error appears in the above-identified patent and that said Letters Patent is hereby corrected as shown below:

a retention groove formed at a distal end of the shaft;
an article support confinement aperture provided at a proximal end of each post;
an article support motion bushing interposed between the article support confinement aperture of a first post of the posts and the towel ring, the article support motion bushing providing a reduced friction surface for the towel ring to move relative to the first post; and
an article support motion bushing interposed between the article support confinement aperture of a second post of the posts and the toilet paper roll support, the article support motion bushing providing a reduced friction surface for the toilet paper roll support to move relative to the second post.

Col. 10, lines 32 – 67, please replace claim 13 with the following:

13. The apparatus of claim 12, in which the first and second leaf spring portions are non-contactingly adjacent one another, and further in which ~~the means for securing to the second leaf spring portion the means for attaching the towel ring to the second leaf spring portion, and~~ the means for securing to the first leaf spring portion the means for attaching the toilet paper roll support to the second leaf spring portion comprises:

~~a raised support region adjacent the article support mounting aperture;~~
~~a fastener adjacent the raised support region and affixed to the retention groove rigidly affixed to the first post, the fastener constraining transverse and lateral movement of the first post relative to the second leaf spring portion, while accommodating rotational motion of the first post to the second leaf spring portion;~~
~~a compression spring load interposed between the raised support region and the distal end of the first post, the compression spring load modulating the rotational motion of the first post relative to the second leaf spring portion;~~
a second raised support region adjacent the second article support mounting aperture;
a second fastener adjacent the second raised support region and affixed to the retention groove rigidly affixed to the second post, the fastener constraining transverse and lateral movement of the second post relative to the first leaf spring portion, while accommodating rotational motion of the second post to the first leaf spring portion; and
a second compression spring load interposed between the second raised support region and the distal end of the second post, the second compression spring load modulating the rotational motion of the second post relative to the first leaf spring portion.

UNITED STATES PATENT AND TRADEMARK OFFICE

CERTIFICATE OF CORRECTION

PATENT NO. : 7,322,551 B2
APPLICATION NO. : 11/043466
DATED : January 29, 2008
INVENTOR(S) : Joseph M. Simonsen It is certified that error appears in the above-identified patent and that said Letters Patent is hereby corrected as shown below:

Col. 11, lines 33 – 43, please replace claim 17 with the following:

17. An article support apparatus comprising:
a bridge portion;
a first leaf spring portion extending from a first end of the bridge portion;
a second leaf spring portion extending from a second end of the bridge portion, wherein the second leaf spring portion provides an article support mounting aperture;
an article support attached to the second leaf spring portion by means for attaching the article support to the second leaf spring portion; and
means for securing to the second leaf spring portion said attaching means, in which the first and second leaf spring portions are non-contactingly adjacent one another, and further in which the means for attaching the article support to the second leaf spring portion comprises:
a post;
a shaft with a proximal end rigidly affixed to a distal end of the post, wherein the shaft is configured for sliding communication with the article support mounting aperture; and
a retention groove formed at a distal end of the shaft. ~~The apparatus of claim 2~~ and in which the article support comprises an adjustable towel bar, and in which the means for attaching the adjustable towel bar to the second leaf spring portion further comprises:
an article support confinement aperture provided at a proximal end of the post; and
an article support motion bushing interposed between the article support confinement aperture and the adjustable towel bar, the article support motion bushing providing a reduced friction surface for the adjustable towel bar to move relative to the post, and further in which the means for securing to the second leaf spring portion the means for attaching the adjustable towel bar to the second leaf spring portion comprises:
a raised support region adjacent the article support mounting aperture;
a fastener adjacent the raised support region and affixed to the retention groove, the fastener constraining transverse and lateral movement of the post relative to the second leaf spring

UNITED STATES PATENT AND TRADEMARK OFFICE

CERTIFICATE OF CORRECTION

PATENT NO. : 7,322,551 B2
APPLICATION NO. : 11/043466
DATED : January 29, 2008
INVENTOR(S) : Joseph M. Simonsen It is certified that error appears in the above-identified patent and that said Letters Patent is hereby corrected as shown below:

portion, while accommodating rotational motion of the second leaf spring portion to the post; and a compression spring load interposed between the raised support region and the distal end of the post, the compression spring load modulating the rotational motion of the second leaf spring portion relative to the post.

Col. 12, lines 1 – 2, please replace claim 20 with the following:

20. The apparatus of claim 19, in which the surface interacting with the internal surface of the interface surface material comprises a surface of a cabinet door.

Signed and Sealed this

Sixteenth Day of June, 2009

John Doll

JOHN DOLL
*Acting Director of the United States Patent and Trademark Office*